US009238916B2

(12) United States Patent
Schneider

(10) Patent No.: US 9,238,916 B2
(45) Date of Patent: Jan. 19, 2016

(54) APPARATUS AND METHOD FOR PROTECTING A DOWNSPOUT OF A GUTTER

(76) Inventor: Stacey Schneider, Waconia (MN)

( * ) Notice: Subject to any disclaimer, the term of this patent is extended or adjusted under 35 U.S.C. 154(b) by 1030 days.

(21) Appl. No.: 13/010,591

(22) Filed: Jan. 20, 2011

(65) Prior Publication Data

US 2011/0173897 A1 Jul. 21, 2011

Related U.S. Application Data

(60) Provisional application No. 61/336,273, filed on Jan. 20, 2010, provisional application No. 61/362,943, filed on Jul. 9, 2010.

(51) Int. Cl.
*F16L 57/00* (2006.01)
*E04D 13/08* (2006.01)

(52) U.S. Cl.
CPC ..... *E04D 13/08* (2013.01); *E04D 2013/0813* (2013.01); *Y10T 428/13* (2013.01)

(58) Field of Classification Search
CPC E04D 13/08; E04D 2013/0813; F16L 57/005
USPC ..... 138/96 R, 96 T, 109; 52/16, 741.3; 239/288.3, 288.5
See application file for complete search history.

(56) References Cited

U.S. PATENT DOCUMENTS 1,785,985 A * 12/1930 Shrum ..... 138/96 T
2,121,436 A * 6/1938 Lytle ..... B65D 59/02 138/96 T
2,215,251 A * 9/1940 Prince ..... B65D 59/06 138/96 T
2,290,842 A 7/1942 Bush
2,397,655 A * 4/1946 Francis ..... 285/148.22
2,794,757 A 6/1957 Bright
2,898,939 A * 8/1959 Fox ..... 405/119
2,942,625 A * 6/1960 Costanzo ..... 138/96 R
2,977,993 A * 4/1961 Scherer ..... 138/96 T
3,167,856 A 2/1965 Zoller
3,222,769 A 12/1965 Le Plae
3,369,261 A * 2/1968 Tiller ..... E03C 1/33 138/96 R
3,744,528 A * 7/1973 Vestal ..... 138/89
3,818,946 A * 6/1974 Bonnes et al. ..... 138/96 R
4,105,814 A 8/1978 Eggert
4,328,694 A 5/1982 Beaumont
4,695,499 A 9/1987 Whitener
4,830,898 A 5/1989 Smith
4,869,945 A 9/1989 Harney
5,280,138 A 1/1994 Preston et al.

(Continued)

FOREIGN PATENT DOCUMENTS

DE 3619299 A1 * 12/1987
EP 188012 A * 7/1986

*Primary Examiner* — Patrick F Brinson
*Assistant Examiner* — Matthew Lembo
(74) *Attorney, Agent, or Firm* — McKee, Voorhees & Sease, PLC

(57) ABSTRACT

An apparatus and method provides for protecting a downspout elbow or extension of a rain gutter from suffering and inflicting harm. The apparatus has a protective outer surface to guard against one or more sharp edges or surfaces of the downspout elbow or extension from suffering or inflicting harm. Methods of protecting the downspout elbow or extension include at least elastically deforming, sliding, rolling, or inverting a portion or all of the apparatus onto the opening and adjacent portions of the downspout elbow or extension.

10 Claims, 9 Drawing Sheets

(56) References Cited

U.S. PATENT DOCUMENTS

| | | | | |
|---|---|---|---|---|
| 5,427,417 | A * | 6/1995 | Lechuga | 285/46 |
| 5,813,701 | A | 9/1998 | Noble | |
| 6,182,676 | B1 | 2/2001 | Lee | |
| 6,240,680 | B1 * | 6/2001 | Estes | 52/16 |
| 6,247,271 | B1 | 6/2001 | Fioritto et al. | |
| 6,341,626 | B1 | 1/2002 | Davenport et al. | |
| 6,367,508 | B1 | 4/2002 | Richards et al. | |
| 6,823,894 | B1 * | 11/2004 | Koller et al. | 137/615 |
| 6,889,985 | B2 | 5/2005 | Bonds | |
| 6,944,992 | B2 | 9/2005 | Brochu | |
| 7,017,614 | B2 | 3/2006 | Handley | |
| 7,117,642 | B2 | 10/2006 | Brown | |
| 7,278,450 | B1 | 10/2007 | Condon | |
| 7,458,532 | B2 * | 12/2008 | Sloan | 239/593 |
| 7,685,778 | B2 * | 3/2010 | Edell | 52/16 |
| 7,736,090 | B2 * | 6/2010 | Janesky | 405/42 |
| 7,739,839 | B1 | 6/2010 | Crabtree | |
| 2001/0009083 | A1 | 7/2001 | Sullivan | |
| 2002/0133952 | A1 | 9/2002 | Kenny | |
| 2004/0182015 | A1 | 9/2004 | Roe et al. | |
| 2005/0086883 | A1 * | 4/2005 | Wade | E04D 13/0645 52/302.1 |
| 2006/0230688 | A1 * | 10/2006 | Carr | 52/16 |
| 2008/0023959 | A1 * | 1/2008 | Crawford | E04D 13/08 285/226 |
| 2008/0138156 | A1 * | 6/2008 | Janesky | 405/40 |
| 2008/0142108 | A1 | 6/2008 | Baker et al. | |
| 2008/0295418 | A1 * | 12/2008 | Edell | 52/16 |

* cited by examiner

APPARATUS AND METHOD FOR PROTECTING A DOWNSPOUT OF A GUTTER

CROSS-REFERENCE TO RELATED APPLICATIONS

This application claims priority under 35 U.S.C. §120 to provisional application Ser. Nos. 61/336,273 filed Jan. 20, 2010 and 61/362,943 filed Jul. 9, 2010, which applications are hereby incorporated by reference in their entirety.

BACKGROUND OF THE INVENTION

1. Field of the Invention

This invention relates generally to an apparatus and method for the downspout of a gutter system, and more particularly to an apparatus and method for both protecting and preserving the structural integrity of a downspout of a gutter system and preventing injury to those who may come in contact with one or more sharp edges associated with a downspout of a gutter system.

2. Description of Prior Art

Gutter systems for transferring runoff water from a roof to the surrounding landscaping or sewer system are well known. Generally, sections of gutter are connected together and secured to a roof generally at the fascia to collect and move runoff water to dispersement points at or near a ground location. The runoff water collected in each run of the gutter system is fed to a downspout which allows the runoff water to be moved from the elevation of the roof to a position at or near ground level. Downspouts or downspout leaders are critical in dispersing the runoff water away from the dwelling. Given that the downspout or downspout leader may extend several feet away from the dwelling, the outlet of the downspout or downspout leader often is positioned in an area of high traffic to children and adults alike. Given the proximity of the outlet of the downspout leader or downspout to an area trafficked by children and adults, ample opportunities arise where, for example, children at play may unintentionally come into contact with the opening of the downspout leader. Given that the edges of the downspout leader present generally sharp and possibly jagged surfaces, that when contacted, can cause harm, there has been a need identified in the art to provide an apparatus and method for protecting adults and children alike, who may come in contact with the opening or other sharp edges associated with a downspout leader, from suffering any harm.

Downspout leaders are also often subject to impact from various objects and individuals working or playing about the dwelling. Any damage imparted to the downspout leader may in turn cause the gutter system or downspout leader to drain improperly or collect debris and thereby backup runoff water back into the gutter system or the dwelling. The damage suffered by a downspout leader ranges from brunt impacts causing bending and other harm to the opening of the downspout leader to tearing or ripping of the material of the downspout leader at or near the opening; each incident is likely to cause the downspout leader to function improperly and thereby cause the drainage system to function improperly as well. Therefore, a need has been identified in the art to provide an apparatus and method for protecting a downspout leader, and particularly the opening in of a downspout leader, from brunt impacts or suffering damage which would in turn cause the downspout leader or gutter system to function improperly.

The present invention addresses these problems and provides an apparatus and method for protecting and maintaining the structural integrity of the opening of a downspout leader.

In addition, the present invention provides an apparatus and method for protecting those who may accidentally come into contact with a downspout leader or the opening of the downspout leader from suffering harm.

SUMMARY OF THE INVENTION

In one embodiment, the invention is an apparatus for protecting a downspout leader of a rain gutter from suffering and/or inflicting harm. The apparatus includes a covering having a protective outer surface to guard against an edge or surface of the downspout leader from suffering or inflicting harm and at least one generally flexible edge to allow the covering to be fixed in position to the downspout leader.

In another embodiment, the invention is a method for protecting a downspout leader of a rain gutter from suffering and/or inflicting harm. The method includes providing a downspout leader and securing a covering having a protective outer surface over an outer edge or surface of the downspout leader for guarding the edge or surface of the downspout leader against suffering or inflicting harm. Methods for securing the covering to the downspout leader include stretching the cover over an edge or outer surface of the downspout leader, rolling the cover over an edge or outer surface of the downspout leader, or stretching a first leg over the outer surface and a second leg over the inner surface of the downspout leader.

BRIEF DESCRIPTION OF THE DRAWINGS

The specification concludes with the claims particularly pointing out and distinctly claiming the invention, and it is believed that the present invention will be better understood from the following description taken in conjunction with accompanying drawings, in which:

DETAILED DESCRIPTION OF THE PREFERRED EMBODIMENTS

Figure 1:
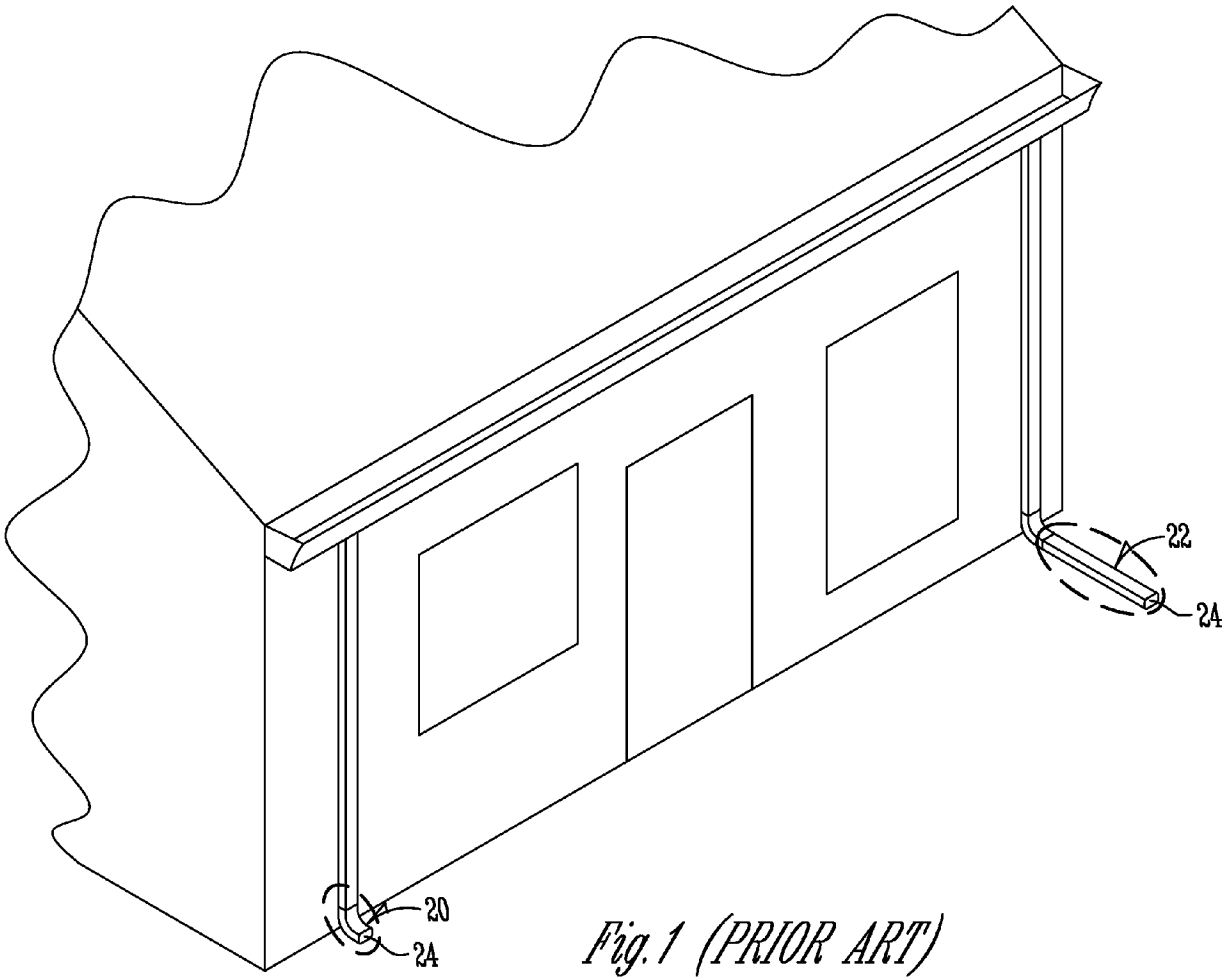
Fig. 1 (PRIOR ART)
FIG. 1 is prior art showing a downspout leader attached to a dwelling.

FIG. 1 illustrates a gutter system associated with a dwelling as are well known and offered as prior art. The gutter system includes a run of gutter attached to the fascia of the dwelling for collecting runoff water. A downspout moves the runoff water from the gutter to a position adjacent the ground. The downspout includes a downspout leader that may extend a short distance or a longer distance away from the dwelling depending upon the need for distributing the runoff water away from the foundation of the dwelling. The downspout or leader may include an elbow or "kickout" for directing runoff away from a foundation. In other instances, a downspout extension may be connected to the elbow to bring runoff further out away from a foundation. Both stick out into away from the foundation or dwelling into space that is often trafficked by those working, playing or relaxing near the foundation or dwelling.

Figure 2A:
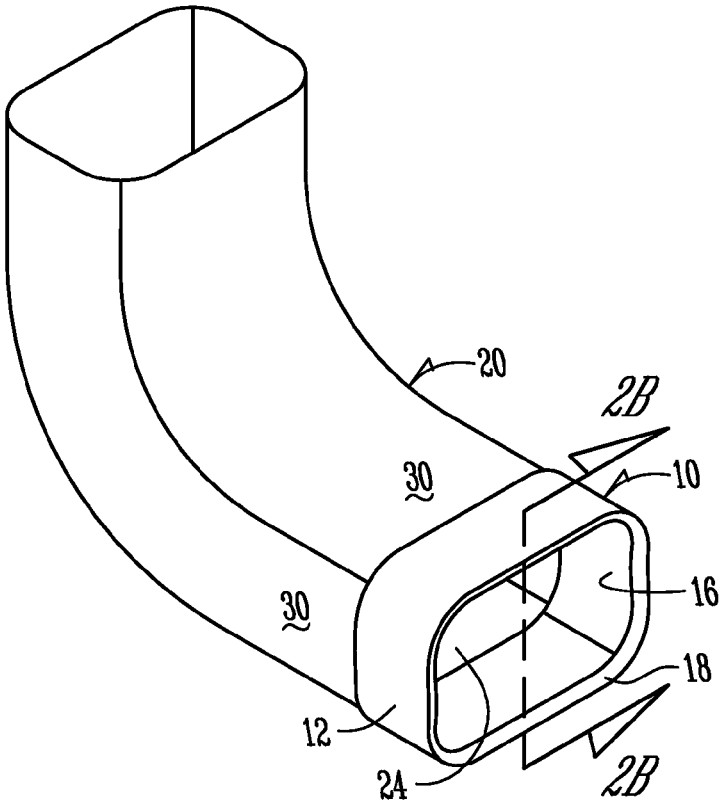
FIG. 2A is a perspective view of an apparatus according to exemplary embodiment of the present invention.
Figure 2B:
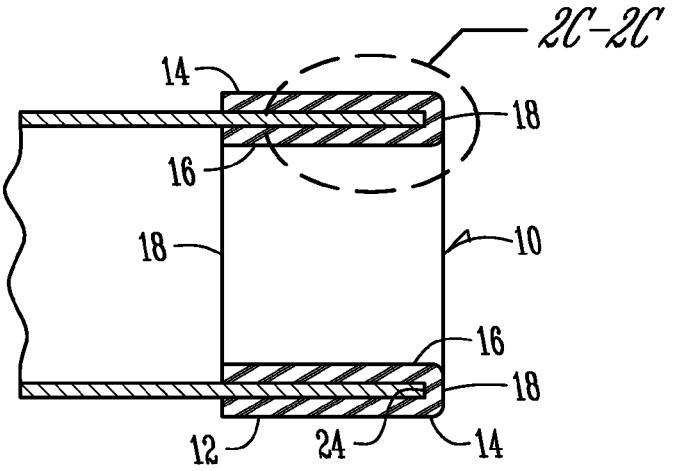
FIG. 2B is a cross-section taken along line 2B-2B in FIG. 2A.
Figure 2C:
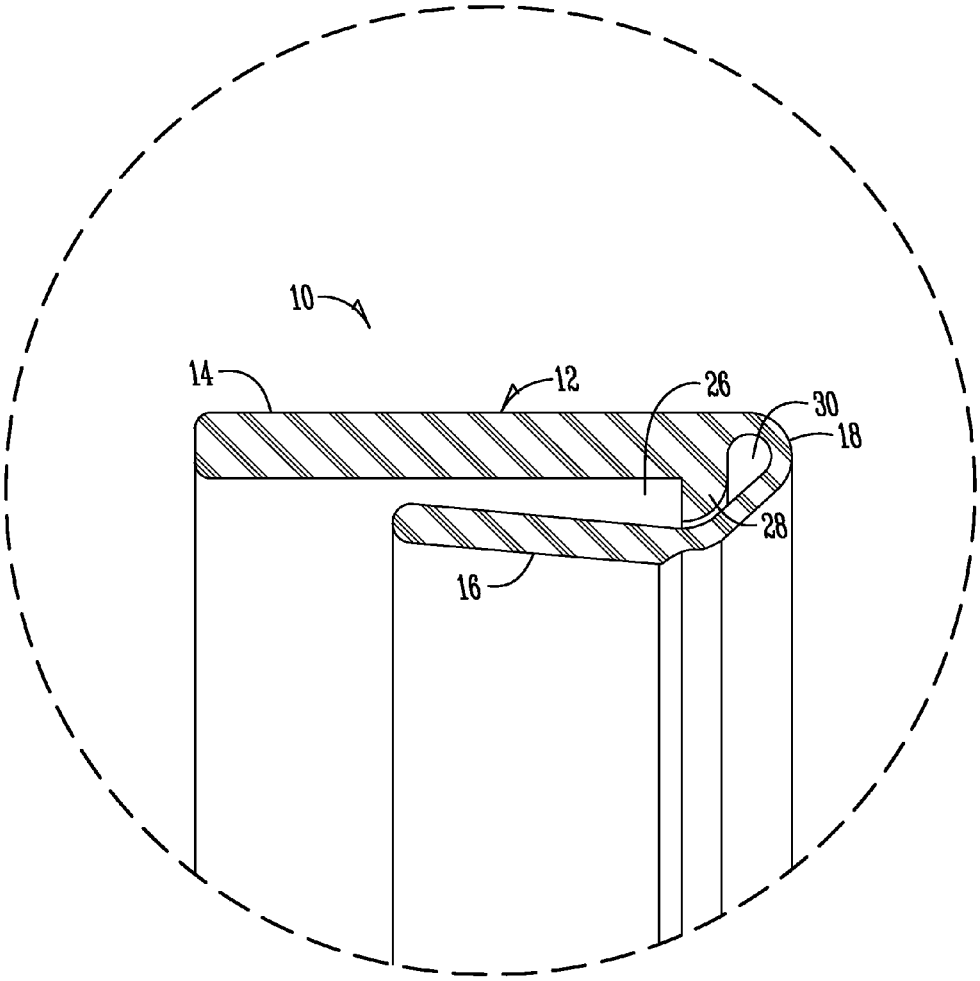
FIG. 2C is a enlarged sectional view taken along line 2C-2C in FIG. 2B exhibiting one sectional profile for the apparatus.

Generally the pieces of the gutter system shown are fabricated from aluminum. This means that the edges, including some surfaces, of the downspout leaders may be very sharp, jagged, rough, or have burrs that easily inflict harm to a passerby who happens to brush up against or run into an edge or sharp surface of the downspout elbow, extension or opening. Furthermore, because the downspout elbow and extension are located at ground level it is often subjected to impact from objects around the dwelling or those passing by. Thus, the downspout elbow or extension may inflict or suffer harm. Aspects of the apparatuses and methods of the present invention are illustrated in FIGS. 2A-6B, and particularly apparatuses and methods for protecting a rain gutter downspout elbow or extension and their openings from suffering and/or inflicting harm. FIG. 2A illustrates one exemplary embodiment of the present invention. In FIG. 2A the apparatus 10 includes a cover 12 made from a flexible/elastic material such as a rubber, polymer or other plastic. In this aspect the present invention, the cover 12 may constitute a cap for the mouth 24 and a portion of the adjacent surfaces 30 of the downspout elbow or extension. The cover 12 could be manufactured of an elastomeric material. Certain portions of the cover 12 could be of one material while other portions of another material. For example, the outer portion 14 could be a hard plastic and the inner portion 16 a more elastic material, such as rubber. The leading edge 18 could also be of the same or different material to protect the opening 24 and absorb impact. The leading edge 18, or other portions of the cover 12, could be colored with a fluorescent color or like "attention-drawing" colors to draw the attention of and divert the would be impact away from the elbow 20 or extension 22, or their openings 24 (see for example FIG. 1). The cover 12 has a generally U-shaped cross-section as best illustrated in FIG. 2B. The covering can be manufactured to fit any style or type of gutter such as K-style gutter, OGEE gutter, half round gutter, facie gutter or box gutter. This means the cover 12 could square, rectangle or circular in shape. The outer surface of the downspout elbow or extension may be smooth or corrugated, depending on the type of gutter. As illustrated in FIGS. 2A-2C, the cover 12 includes an outer portion 14 or first leg connected to an inner portion 16 or second leg by the leading edge 18. In one aspect of the invention, the two portions in their relaxed position are generally parallel to one another and in another aspect the inner portion 16 is angled toward the outer portion 14 in their relaxed positions as shown in FIG. 2C. In one aspect, the inner portion 16 may be pre-tensioned against the outer portion 14 to create a tension fit across the channel 26. In another aspect, ribs or other extrusions may extend slightly into the channel 26 from either or both the inner or outer portions to help prevent unintended detachment of the cover 12 from the downspout elbow or extension. The inner and outer portions have a small channel 26 between them. In one aspect, the width of the channel 26 is at least generally equal to the thickness of the walls of the downspout elbow or extension. The channel 26 may be tapered to create a friction fit between the cover 12 and the openings 24 of the downspout elbow or extension. The channel 26 may also be slightly undersized in width, depending on the elasticity of the material used, so as to form a compression fit to the downspout elbow or extension. As shown in FIG. 2C, a bumper 28 may be interposed in the channel 26, attached to either or both the inner and outer portions of the cover 12, to provide a stopping point for the mouth of the downspout elbow or extension when inserted into the channel 26. Between the leading edge 18 and the bumper 28, the cover 12 may include a crumple zone configured to help absorb an impact. The length of each one of the legs forming the inner and outer portions of the cover 12 may be adjusted in length to provide additional protection to the outer surface and the overall structural integrity of the downspout elbow or extension. For example, the inner and outer portions may be lengthened so that the cover 12 extends along a greater portion of the length from the mouth of the downspout elbow or extension, or shortened so that the inner and outer portions cover a smaller portion of the length of the downspout elbow or extension. The outer portion 14 covering the outer surface may be longer than the inner portion 16 covering the inner surface of the downspout elbow or extension. For example, the inner portion 16 may be shortened so as to limit the amount of cover material covering the inner surfaces to prevent the cover 12 from attracting and preventing debris in the runoff water from passing uninhibited through the downspout elbow or extension. In another embodiment, the inner portion 16 of the cover 12 may be shortened so as to provide only a portion for covering or protecting the mouth of the downspout elbow or extension from impact or from inflicting harm to a passerby who happens upon the downspout elbow or extension. The embodiments discussed and illustrated generally by FIGS. 2A-2C are each configured having a channel 26 between the two legs so that the cover 12 may be secured to the end or mouth of the downspout elbow or extension by sliding the end of the downspout elbow or extension into the channel 26 so as to create a cap over the terminal edges (e.g., mouth) and/or adjacent surfaces 30 of the downspout elbow or extension.

Figure 3A:
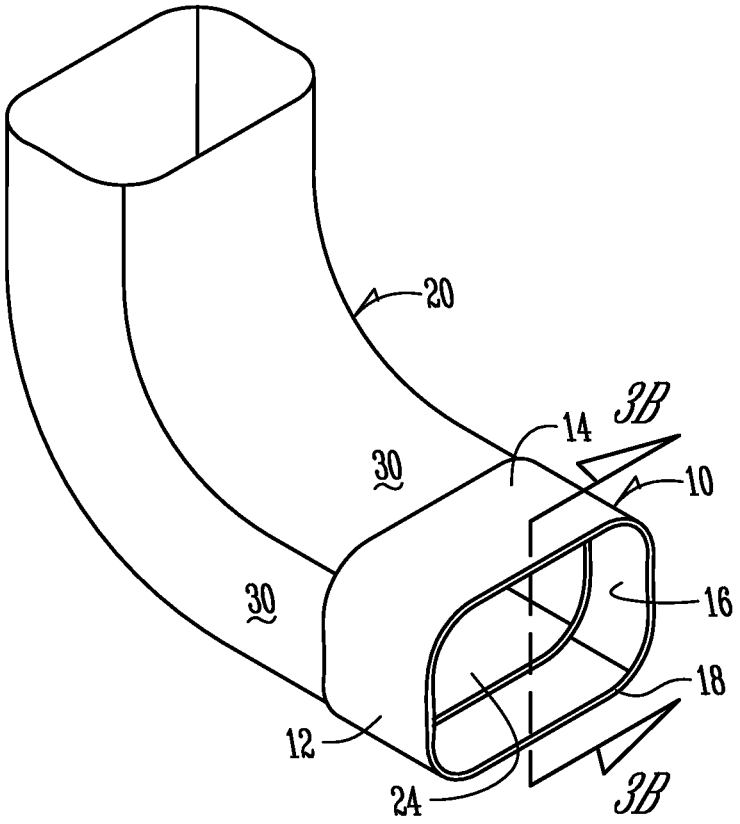
FIG. 3A is a perspective view of another apparatus of the present invention.
Figure 3B:
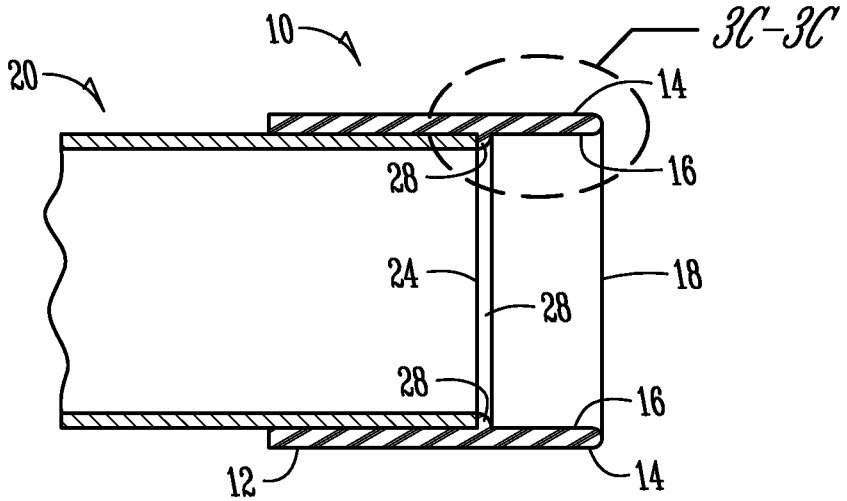
FIG. 3B is a cross-sectional view taken along line 3B-3B in FIG. 3A.
Figure 3C:
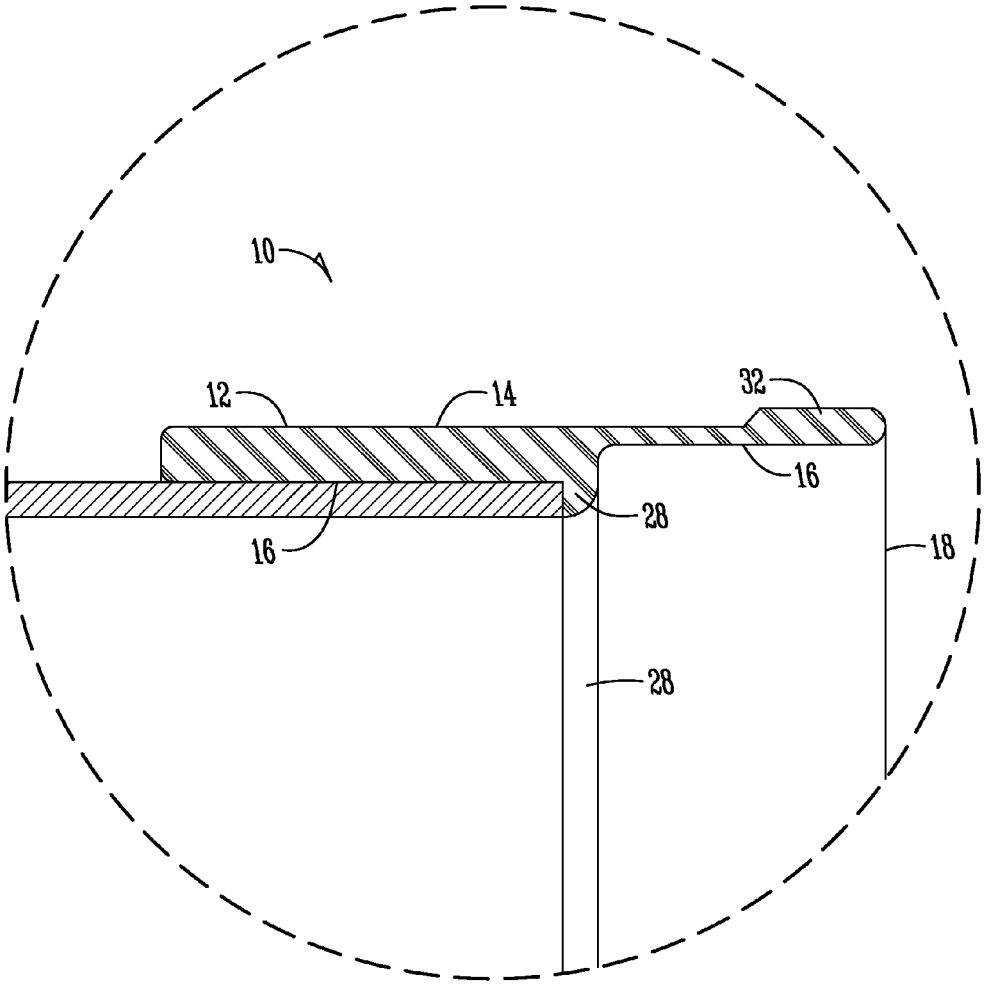
FIG. 3C is a enlarged sectional view taken along line 3C-3C in FIG. 3B exhibiting one sectional profile for the apparatus.

As indicated above, one aspect of the invention allows runoff water including debris to flow uninhibited through the downspout elbow or extension as shown in FIGS. 3A-3C. The apparatus 10 includes a cover 12 that is configured in the form of a sleeve using preferably a material having some elasticity, such as rubber, to allow it to be expanded over and secured to the downspout elbow or extension. A portion of the cover 12 may extend outward from and hang over the mouth 24 of the downspout elbow or extension to protect a passerby who happens to make contact with the downspout elbow or extension from suffering any harm from the sharp edges of mouth of the downspout elbow or extension, and to help protect the mouth 24 of the downspout elbow or extension against damage. The overhanging portion may include stiffeners to maintain its shape and provide an element of rigidity. The stiffeners could be an external rib 32 (see FIG. 3C) or internal feature (i.e., contained in the wall of the cover 12 between the inner and outer portions) fabricated from a material having a stiffness greater than the wall material for the cover 12. As with the cover illustrated in FIGS. 2A-2C, the cover 12 shown in FIGS. 3A-3C may be configured from varying types of materials, including layers of different material types to best suit each design. For example, a portion of the cover 12 may be configured of an elastic or rubber type material to allow the sleeve to be stretched and slipped over the mouth of the downspout elbow or extension, whereas the end portion 18 of the cover 12 may be configured of a more rigid or solid plastic material to protect both the mouth 24 and adjacent surfaces 30 of the downspout elbow or extension from suffering or inflicting harm. The cover 12, which is generally sleeve-shaped, includes an outer portion 14 to protect the downspout elbow or extension and an inner portion for seating and securing the cover 12 to the downspout elbow or extension. The material properties of the outer portion 14 may be different from the inner portion 16. For example, the outer portion 14 may be a semi-rigid shell for protecting the integrity of the downspout elbow or extension while the inner portion 16 may be impressionable to mold and attach to the walls of the downspout elbow or extension. An annular-shaped bumper 28, preferably the thickness of the gutter wall, creates a stop for placement of the cover 12 on the downspout elbow or extension and provides a smooth transition onto the inner portion 16 of the cover 12 for runoff water passing through the downspout elbow or extension. Notably, runoff water and debris passing through the downspout elbow or extension is not impeded or interrupted by an edge or surface of the cover 12 extending into the mouth of the downspout elbow or extension. This permits runoff water and any associated debris to run freely through the downspout elbow or extension and cover 12, and aids in preventing the downspout elbow or extension from becoming clogged or blocked.

Figure 4A:
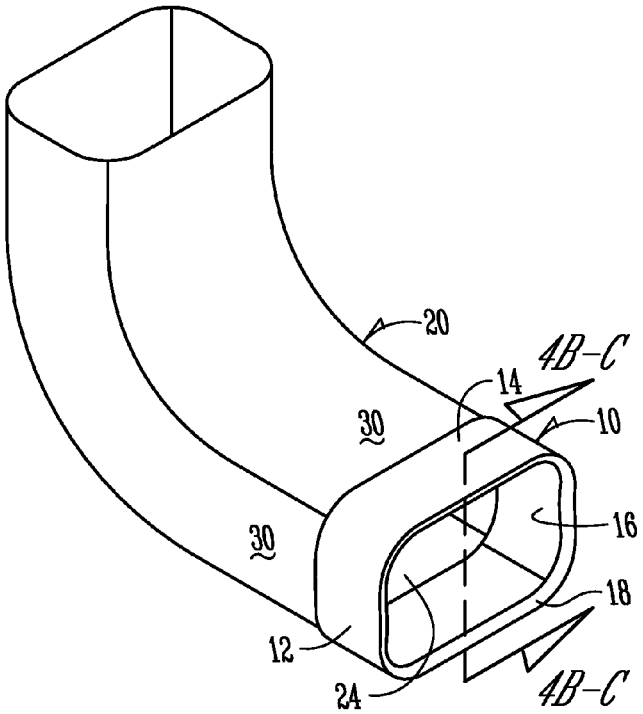
FIG. 4A is a perspective view of an apparatus according to an exemplary embodiment of the invention.
Figure 4B:
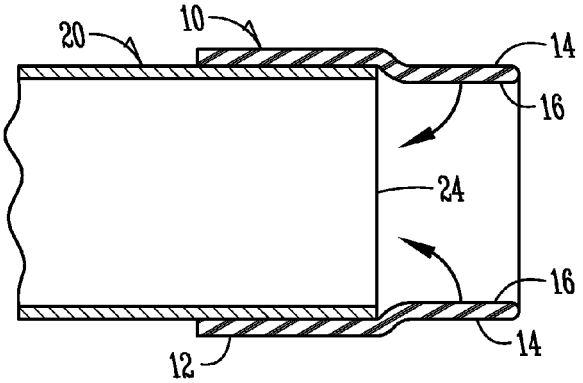
FIG. 4B is a sectional view taken along line 4B-4B in FIG. 4A of the apparatus partially secured to the downspout opening.
Figure 4C:
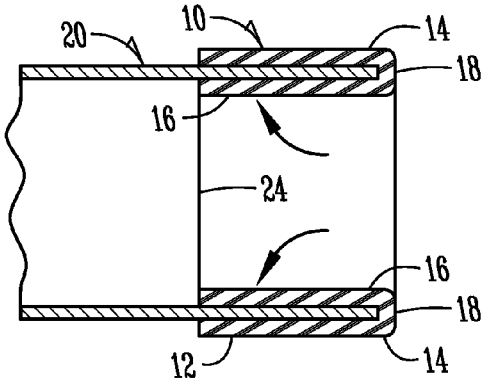
FIG. 4C is a sectional view taken along line 4C-4C in FIG. 4A of the apparatus fully secured to the downspout opening.

FIGS. 4A-4C illustrates one apparatus 10 and method of the present invention. The cover 12 as illustrated in FIGS. 4A-4C includes a protective outer portion 14 to guard against an edge or surface of the downspout elbow or extension from suffering or inflicting harm. The cover 12 also includes at least one generally flexible edge 18 to allow the cover 12 to be fixed into position over the outer surface 30 of the downspout elbow or extension as shown. The cover 12 may include multiple material types or properties so as to have one part of the material being elastic or stretchable and another part of the cover having a hardened rubber outer coating to protect the downspout elbow or extension from impacts and to prevent harm being inflicted to those who may come in contact with sharp edges or surfaces of the downspout elbow or extension. As best illustrated in FIGS. 4B-4C, the cover 12 includes a portion, preferably being expandable, of sufficient material elasticity to stretch over the outer surface 30 of the downspout elbow or extension to secure the cover 12 to the downspout elbow or extension. To secure the cover to the downspout leader, the inner portion 16 of the part of the cover 12 overhanging the mouth of the downspout elbow or extension is rotated at the flexible edge 18 (in the direction of the arrows) into contact with inner surfaces 30 of the downspout elbow or extension as illustrated to create a cap over the mouth and surfaces (both inner and outer surfaces 30) of the downspout elbow or extension. The inner portion 16 rotated into the mouth 24 of the downspout elbow or extension may have a tapered profile (as viewed in cross-section) so as to limit the amount of drag and potential for inhibiting the flow of runoff water and debris out of the downspout elbow or extension. The cover 12 may include more than one flexible edge 18 along its length to allow more or less cover 12 to be folded into the mouth 24, or more or less cover 12 to cover the mouth 24 and adjacent surfaces 30 of the downspout elbow or extension.

Figure 5A:
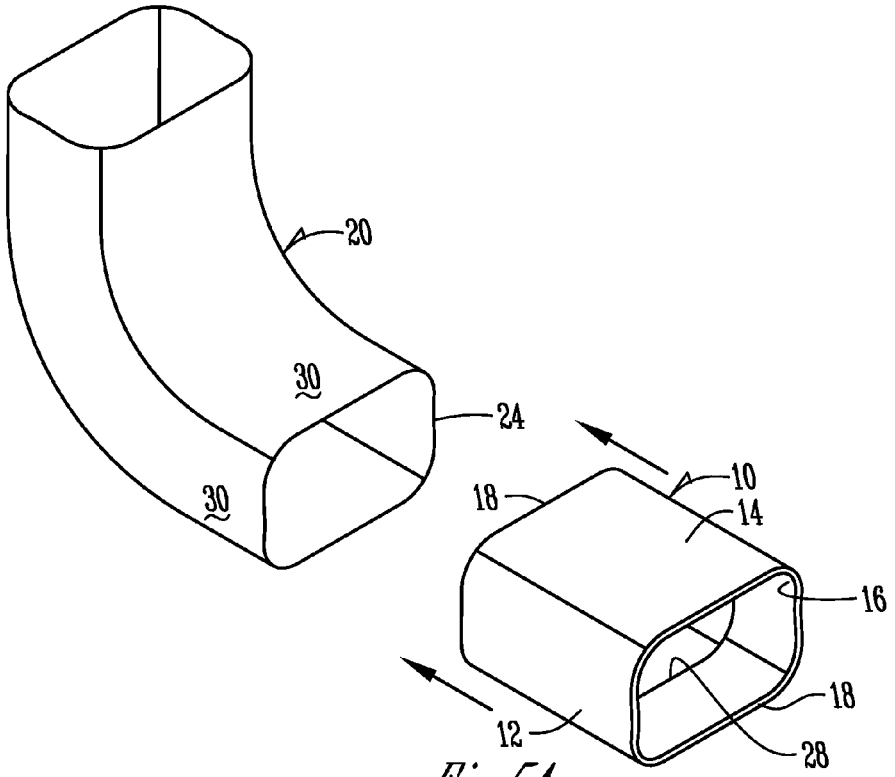
FIGS. 5A-B are perspective views of another apparatus according to an exemplary aspect of the present invention.
Figure 5B:
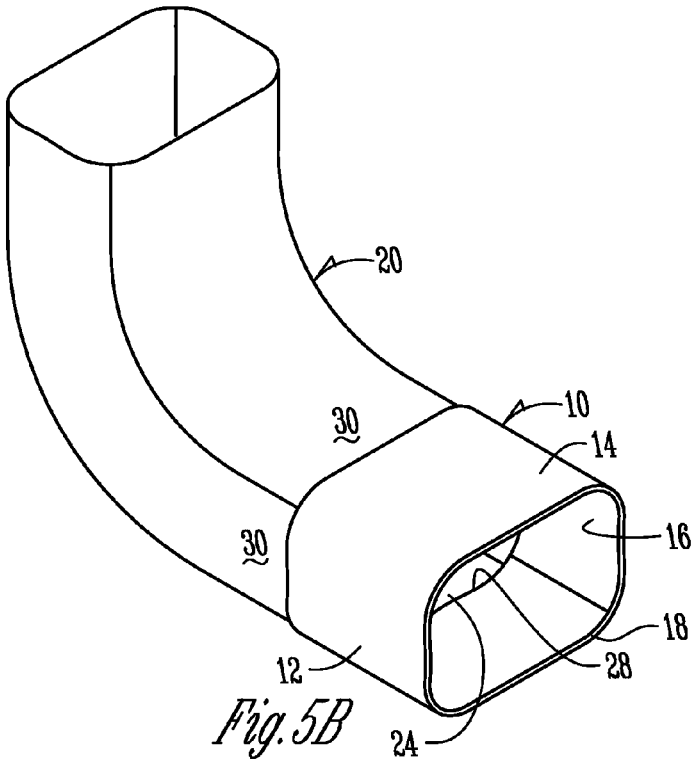
Figure 5C:
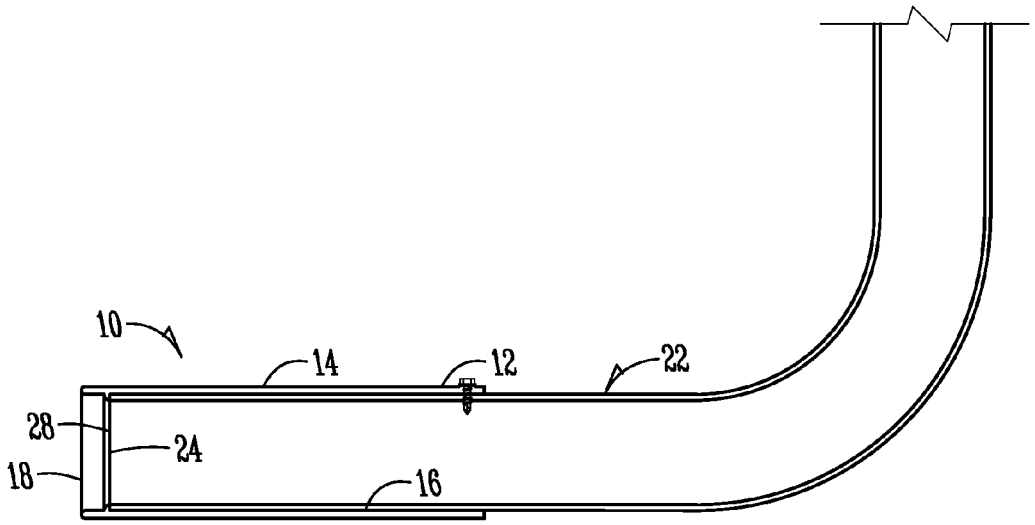
FIGS. 5C-D are side elevation views of other apparatuses of the invention according to the exemplary aspects shown in FIGS. 5A-B.
Figure 5D:
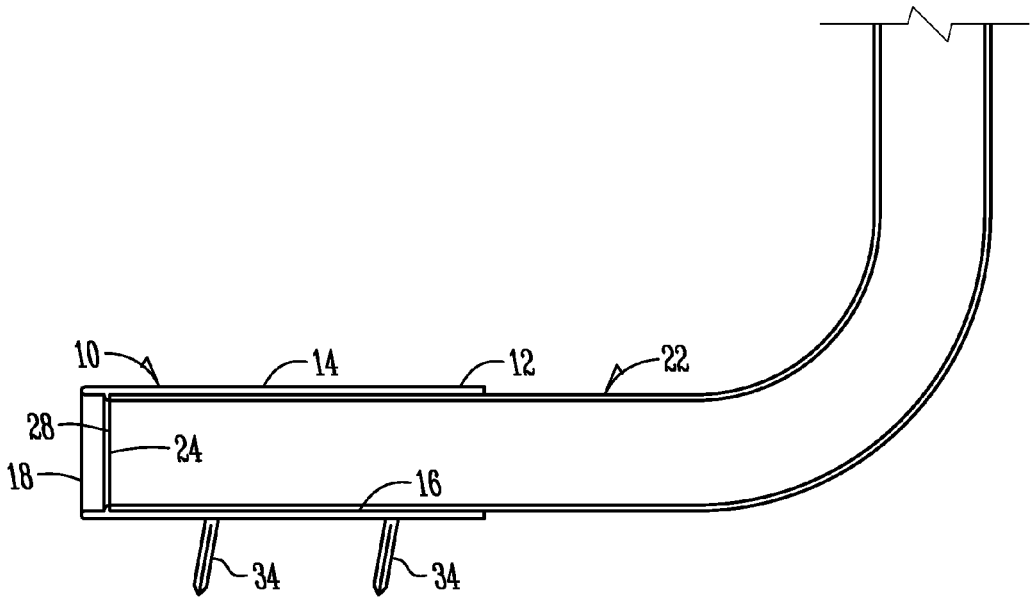

FIGS. 5A-5B illustrate another aspect of the present invention. The apparatus 10 illustrated in FIGS. 5A-5B comprises a cover 12 having a semi rigid to fully rigid protective outer portion 14 to guard against an edge or surface of the downspout elbow or extension from suffering or inflicting harm. In one embodiment, the outer portion 14 of the cover 12 comprises a hardened shell having a similar shape to the downspout elbow or extension but being oversized so as to slip over the top of the mouth 24 and adjacent surfaces 30 of the downspout elbow or extension as illustrated. The hardened outer portion 14 of the cover 12 protects the downspout elbow or extension from impact from objects or passersby. The inner portion 16 of the cover 12 may be fabricated of the same or different material than the outer portion 14. A semi-annular shaped bumper 28 (e.g., an annular rib) extends around the circumference of the inner portion 16 to provide a stop when sliding the cover 12 onto the downspout elbow or extension. The bumper 28 is positioned at an optimal location between opposing edges 18 of the cover 12. For example, if the bumper 28 is positioned in the middle, a portion of the cover 12 overhangs the mouth of the downspout elbow or extension to protect the edges from impact and to prevent harm from being inflicted to those who pass by and may brush up against or impact sharp edges or surfaces of the downspout elbow or extension. As illustrated, the cover 12 is positioned onto the downspout elbow or extension by sliding the cover 12 over the outer surface 30 of the downspout elbow or extension. The tolerances between the cover 12 and the outer surfaces 30 of the downspout elbow or extension may be controlled so the cover 12 secures snuggly to the downspout elbow or extension to prevent it from coming off. For example, the cover 12 may be tapered so that the end being inserted first onto the downspout elbow or extension has a larger periphery than the tailing end. This way, as the cover 12 is placed over the outer surface 30 of the downspout elbow or extension the gradual tapering of the geometry of the cover 12 causes the covering to bind up against and secure to the outer surface 30 of the downspout elbow or extension to prevent it from falling off or coming unsecured from the downspout elbow or extension. FIGS. 5C-D illustrate elongated versions of the cover 12 shown in FIGS. 5A-B. The cover 12 has an elongated sleeve-like body for covering a greater portion of the downspout elbow or extension. The cover 12 is fabricated from a rigid plastic or other like material to protect the structural integrity of the downspout elbow or extension from impact that might otherwise damage the downspout elbow or extension. The inner portion 16 of the cover 12 includes a bumper or rib 28, either continuous or non-continuous, to stop the cover at a desired point when slid over the outer surface 30 of the downspout elbow or extension. As shown, the bumper 28 is adjacent one end 18 of the cover 12 whereby the better portion of the cover 12 covers the outer surface 30 of the downspout elbow or extension leaving a small portion overhanging the mouth 24 of the downspout elbow or extension to protect the mouth 24 from being damaged or inflicting harm to someone who might otherwise happen upon a sharp, jagged edge of the downspout elbow or extension. A sheet metal screw or like attachment means could be used to secure the cover 12 to a downspout elbow or extension 22. In FIG. 5D, the outer portion 14 of the cover 12 includes downwardly extending stakes or spikes 34 for securing the cover 12 over the outer surface 30 of the downspout elbow or extension and keeping the downspout elbow or extension tethered to the ground to keep the downspout elbow or extension in place notwithstanding impacts or bumps from people, objects or equipment. In one aspect of the invention, the stakes 34 may be angled relative to the outer portion 14 of the cover 12 to help keep the cover 12 tethered to the ground and secured over the outer surface 30 of the cover 12. For example, the stakes 34 could be configured at an acute angle relative to the outer portion 14 of the cover 12.

Figure 6A:
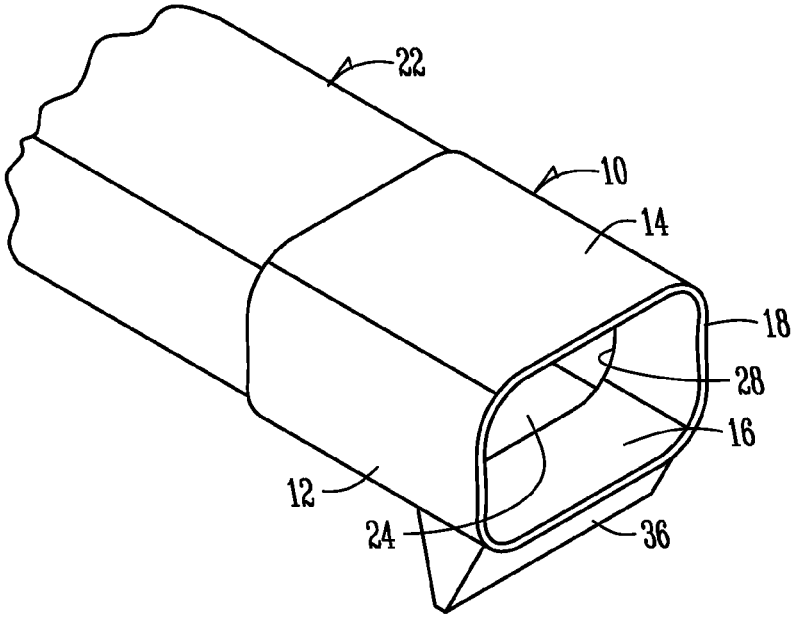
FIGS. 6A-B are perspective views of other exemplary apparatuses of the present invention.
Figure 6B:
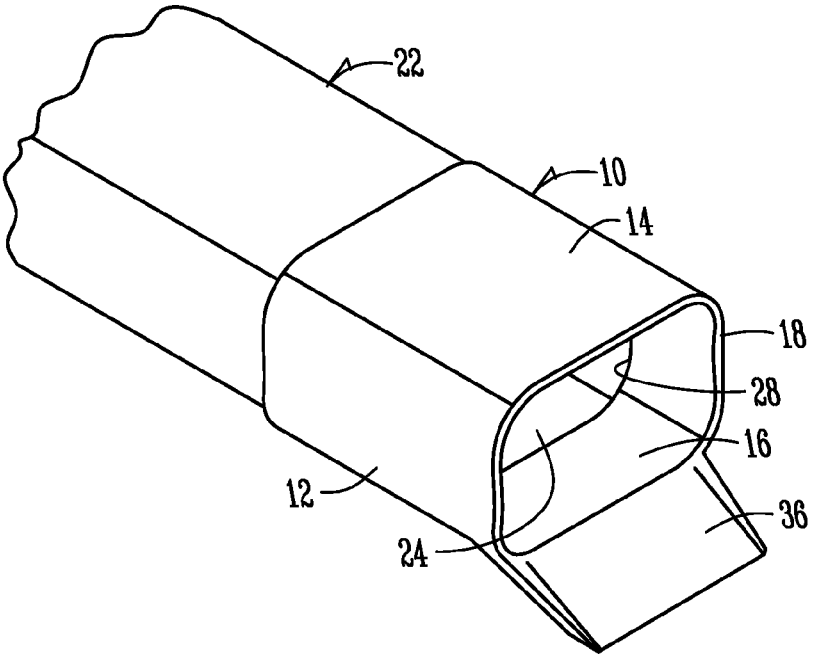

FIGS. 6A-B illustrate another aspect of the present invention. In FIG. 6A the cover 12 includes a downwardly extending member 36 attached to the bottom of the outer portion 14 of cover 12. Member 36 is preferably a unitary part of the cover 12. Member 36 functions to lift and/or keep the downspout elbow or extension off the ground, it also may be used as a stake or spike to secure both the cover 12 and downspout elbow or extension against movement, and particularly the cover from becoming separated from the downspout elbow or extension. Member 36 may extend the entire length or a portion of the length of the cover 12. Member 36 also provides a structural rib for supporting or adding rigidity to one or more of the various types of materials used to fabricate the cover 12. In FIG. 6B the member 36 is angled downwardly between roughly 15-60 degrees to provide a channel or trough 38 for directing flow of runoff water and debris onto the surrounding ground. In one aspect of this invention, member 36 extends outwardly and downwardly from the bottom edge 18 of the cover 12. Both designs for member 36 shown in FIGS. 6A-B can be used with any one of the caps, covers or sleeves illustrated in the present invention.

Other embodiments for protecting the downspout elbow or extension are also contemplated. For example, the terminal edges 18 and adjacent surfaces 30 of the downspout elbow or extension may be protected by inserting the edges and surfaces into a plastic coating material such as PLASTI-DIP provided by U.S. Plastics Inc. These and other embodiments contemplated are shown and contemplated by the following claims.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A rain gutter end cap comprising:

a U-shaped body having a unitary construction of a semi-rigid material, the U-shaped body comprised of in a relaxed shape:

(a) a first pair of opposing, parallel and linear portions;

(b) a second pair of opposing, parallel and linear portions;

(c) four curved portions, each of the four curved portions formed integrally to one of the first pair of opposing, parallel and linear portions and one of the second pair of opposing, parallel and linear portions;

a cross-section of the U-shaped body comprising an inner leg, an edge leg and an outer leg, wherein the inner leg, edge leg and outer leg are connected together and have an integral and unitary form of the U-shaped body;

wherein the inner leg includes an outer surface, an inner surface and an edge surface, the outer surface of the inner leg spaced apart from the inner surface of the inner leg by the edge surface of the inner leg;

wherein the outer leg includes an outer surface, an inner surface and an edge surface, the outer surface of the outer leg spaced apart from the inner surface of the outer leg by the edge surface of the outer leg;

wherein the edge leg includes an outer surface and a planar inner surface, the outer surface of the outer leg spaced apart from the outer surface of the inner leg by the outer surface of the edge leg, the inner surface of the outer leg spaced apart from the inner surface of the inner leg by the inner surface of the edge leg;

a rectangular shaped gap in the relaxed position, the rectangular shaped gap extending inwardly within the first pair of opposing, parallel and linear portions, the second pair of opposing, parallel and linear portions, and the four curved portions, wherein the rectangular shaped gap has an outer side boundaried by the inner surface of the outer leg, an edge side boundaried by the inner surface of the edge leg and an inner side boundaried by the inner surface of the inner leg, and wherein the rectangular shaped gap configured to receive a terminal end of a gutter downspout;

an interference fit with the terminal end of the gutter downspout wherein the interference fit extends substantially along an entirety of the inner surface of the outer leg and the inner surface of the inner leg when the terminal end of the gutter downspout is received within the rectangular shaped gap and contacts substantially along an entirety of the inner surface of the edge leg; and wherein in the relaxed shape a pair of side legs comprising the U-shaped body are spaced apart by a top leg and opposite bottom leg both comprising the U-shaped body, the pair of side legs, the top leg and the bottom leg together form a rectangular shaped end cap body, the pair of side legs and the top leg and the bottom leg are substantially parallel in the relaxed shape.

2. The gutter end cap of claim 1 wherein the inner surface of the outer leg is oriented 90° relative to the inner surface of the edge leg in the relaxed shape.

3. The gutter end cap of claim 1 wherein the inner surface of the inner of the inner leg is oriented 90° relative to the inner surface of the edge leg in the relaxed shape.

4. The gutter end cap of claim 1 wherein the rectangular shaped end cap body is a single piece construction having a unitary body comprising the U-shaped body.

5. The gutter end cap of claim 1 wherein the inner leg and the outer leg are in a state of tension in the relaxed shape.

6. The gutter end of claim 1 wherein the relaxed shape of the rectangular shaped end cap body provides a state of tension for the interference fit.

7. The gutter end cap of claim 1 wherein the inner surface of the outer leg and the inner surface of the inner leg are planar.

8. The gutter end cap of claim 1 wherein the semi-rigid material occupies the entirety of the space between;

a. the outer and the inner surface of the outer leg;

b. the outer and the inner surface of the inner leg; and c. the outer and the inner surface of the edge leg.

9. A rain gutter end cap comprising:

a pair of parallel side legs spaced apart by a top leg and a bottom leg in a relaxed position, the pair of side legs, the top leg and the bottom leg comprising a continuous, integral and unitary rectangular shaped body of an elastically deforming material;

a cross-section of the rectangular shaped body comprises a U-shaped body having an inner leg, an edge kg and an outer leg, wherein the inner leg, the edge leg and the outer leg are connected together to have an integral and unitary form of the U-shaped body, wherein the inner leg includes an outer surface, an inner surface and an edge surface, the outer surface of the inner leg spaced apart from the inner surface of the inner leg by the edge surface of the inner leg, wherein the outer leg includes an outer surface, an inner surface and an edge surface, the outer surface of the outer leg spaced apart from the inner surface of the outer leg by the edge surface of the outer leg, wherein the edge kg includes an outer surface and a planar inner surface, the outer surface of the outer leg spaced apart from the outer surface of the inner leg by the outer surface of the edge leg, the inner surface of the outer leg spaced apart from the inner surface of the inner leg by the inner surface of the edge leg, and wherein the inner surface of the outer and inner legs is substantially planar;

a continuous, rectangular shaped gap in the relaxed position, the continuous, rectangular shaped gap extending inwardly within the pair of parallel side legs, the top leg and the bottom leg, wherein the continuous, rectangular shaped gap has an outer side boundaried by the inner surface of the outer leg, an edge side boundaried by the inner surface of the edge leg and an inner side boundaried by the inner surface of the inner leg, and wherein the continuous, rectangular shaped gap is configured to receive a terminal end of the gutter downspout;

an interference fit with the terminal end of the gutter downspout wherein the interference fit extends substantially along an entirety of the inner surface of the outer leg and the inner surface of the inner leg when the terminal end of the gutter downspout is received within the continuous, rectangular shaped gap;

a contact surface comprised of the inner surface of the outer leg, the inner surface of the edge leg, and the inner surface of the inner leg, the contact surface being rectilinear;

an installed shape wherein the pair of side legs and the top leg and the bottom leg are shaped to fit to the terminal end of the gutter downspout; and wherein the cross-section of the U-shaped body is comprised of a single material from the inner surface of the inner leg to the outer surface of the inner leg, the inner surface of the inner leg to the outer surface of the outer leg, and the inner surface of the inner leg to the outer surface of the edge leg, wherein the outer leg and the inner leg take on the conforming shape of the end of the gutter downspout from an elastic response of the elastically deforming material.

10. The gutter end of claim 9 wherein the relaxed position of the rectangular shaped end cap body provides a state of tension for the interference fit.

* * * * *

UNITED STATES PATENT AND TRADEMARK OFFICE

CERTIFICATE OF CORRECTION

PATENT NO. : 9,238,916 B2
APPLICATION NO. : 13/010591
DATED : January 19, 2016
INVENTOR(S) : Stacey Schneider It is certified that error appears in the above-identified patent and that said Letters Patent is hereby corrected as shown below:

In Column 7, Claim 1, line 47:

Insert a --,-- between the words "of" and "in".

In Column 8, Claim 9, line 61:

After the occurrence of the word edge, delete "kg" and insert --leg--.

In Column 9, Claim 9, line 5:

After the occurrence of the word edge, delete "kg" and insert --leg--.

Signed and Sealed this
Third Day of May, 2016

Michelle K. Lee

Michelle K. Lee
*Director of the United States Patent and Trademark Office*